US011541302B2

(12) United States Patent
Kreuzer et al.

(10) Patent No.: US 11,541,302 B2
(45) Date of Patent: Jan. 3, 2023

(54) AIRPLAY ACTIVITY TABLE

(71) Applicant: TOMY International, Inc., Dyersville, IA (US)

(72) Inventors: Jared Kreuzer, Deerfield, IL (US); Matthew R. Synowicz, Naperville, IL (US)

(73) Assignee: TOMY INTERNATIONAL, INC., Dyersville, IA (US)

( * ) Notice: Subject to any disclaimer, the term of this patent is extended or adjusted under 35 U.S.C. 154(b) by 0 days.

(21) Appl. No.: 17/017,012

(22) Filed: Sep. 10, 2020

(65) Prior Publication Data

US 2021/0069579 A1 Mar. 11, 2021

Related U.S. Application Data

(60) Provisional application No. 62/898,368, filed on Sep. 10, 2019.

(51) Int. Cl.

| | |
|---|---|
| ***A63F 7/36*** | (2006.01) |
| ***A63H 23/10*** | (2006.01) |
| ***A63H 13/20*** | (2006.01) |

(52) U.S. Cl.

CPC ..... *A63F 7/3603* (2013.01); *A63H 13/20* (2013.01); *A63H 23/10* (2013.01); *A63F 2007/3674* (2013.01)

(58) Field of Classification Search

CPC ..... A63F 2007/3674; A63F 7/3603; A63F 7/0636; A63F 7/0632; A63F 7/066; A63F 2009/0087; A63H 23/10; A63H 13/20

USPC ..... 273/126 R, 126 A, 129 AP; 446/227

See application file for complete search history.

(56) References Cited

U.S. PATENT DOCUMENTS

| | | | | | |
|---|---|---|---|---|---|
| 1,824,388 | A * | 9/1931 | Birch | F04D 25/08 | 40/439 |
| 2,911,745 | A * | 11/1959 | Simon | G09F 19/00 | 40/407 |
| 3,773,325 | A * | 11/1973 | Crossman | A63F 7/0058 | 273/126 A |
| 3,931,974 | A * | 1/1976 | Goldfarb | A63F 7/3603 | 273/126 R |
| 3,954,267 | A * | 5/1976 | Freeman | A63F 7/3603 | 273/126 A |
| 4,014,543 | A * | 3/1977 | Arad | A63F 7/066 | 273/108.53 |
| 4,765,079 | A * | 8/1988 | Takahashi | G09F 19/00 | 40/412 |

(Continued)

FOREIGN PATENT DOCUMENTS

| | | |
|---|---|---|
| CA | 2956790 A1 | 2/2016 |
| DE | 60314185 T2 | 2/2008 |

(Continued)

*Primary Examiner* — Sebastiano Passaniti
(74) *Attorney, Agent, or Firm* — Husch Blackwell LLP

(57) ABSTRACT

An air table system is provided. Such a system includes an air table that includes a plurality of holes or perforations, a fan that blows air through the plurality of holes or perforations when activated, a puck component that glides across the air table when the fan blows the air through the plurality of holes or perforations, and an air activated component. The air activated component is positioned around an edge of the air table and includes an air activatable feature configured to be activated by the air when the air activated component is placed on the air table.

13 Claims, 12 Drawing Sheets

(56) References Cited

U.S. PATENT DOCUMENTS 5,186,675 A * 2/1993 D. Stoddard ..... A63H 3/06 40/212
5,356,135 A * 10/1994 Montgomery ..... A63B 24/0021 273/126 A
5,556,181 A 9/1996 Bertrand
5,788,231 A * 8/1998 To ..... A63F 7/3603 273/119 A
6,173,656 B1 * 1/2001 Blanchard ..... A47B 23/002 108/43
6,186,857 B1 * 2/2001 Gazit ..... G09F 15/0025 40/406
6,234,476 B1 * 5/2001 Yamashita ..... A63F 7/3603 273/126 A
6,428,185 B1 * 8/2002 Lin ..... F21V 1/06 362/253
6,547,628 B1 4/2003 Long
6,637,814 B1 * 10/2003 Bellows ..... A63H 33/00 297/137
6,715,826 B2 * 4/2004 Bellows ..... A63H 33/006 297/136
6,854,799 B1 2/2005 Asbach et al.
6,896,575 B2 5/2005 Fair et al.
7,048,604 B2 * 5/2006 Cusolito ..... A63H 33/40 273/441
7,178,803 B2 * 2/2007 Nally ..... A63B 67/14 273/108
7,198,538 B2 * 4/2007 Chin-Cheng ..... A63H 3/06 446/220
7,244,165 B2 7/2007 Gubitosi et al.
7,287,768 B2 10/2007 Myers et al.
7,389,987 B1 * 6/2008 Paukert ..... A63F 7/025 273/108.1
7,510,238 B2 * 3/2009 McClintock ..... A47D 3/00 297/137
7,523,984 B2 4/2009 Steininger
7,578,720 B2 * 8/2009 Drosendahl ..... A47D 3/00 446/227
7,611,417 B2 * 11/2009 Murrey ..... A63D 15/00 473/1
7,614,930 B2 * 11/2009 Berkey ..... A63H 33/006 5/655
7,740,560 B2 6/2010 Tadin et al.
7,954,819 B2 * 6/2011 Lokos ..... A63F 7/0017 273/119 R
8,186,282 B1 5/2012 Sinchok et al.
8,684,357 B2 * 4/2014 Brooks ..... A63F 7/0636 273/126 A
8,795,023 B2 8/2014 Elson
8,800,186 B2 * 8/2014 Zhang ..... G09F 19/08 40/610
9,032,883 B2 5/2015 Roy et al.
9,266,031 B2 2/2016 Suh
9,339,120 B2 5/2016 Speer
9,629,474 B2 4/2017 Wilson
9,930,972 B2 4/2018 Janay
10,000,225 B2 6/2018 Burns et al.
10,342,361 B2 * 7/2019 Cotirla ..... A47D 15/00
10,456,701 B2 * 10/2019 Healy ..... A47D 11/002
10,463,171 B2 11/2019 Healy et al.
10,588,996 B2 * 3/2020 Warkentin ..... A61L 9/122
10,751,439 B2 * 8/2020 Warkentin ..... A61L 9/12
11,071,294 B1 * 7/2021 Draeger ..... G09F 19/08
2003/0129572 A1 7/2003 Shuler et al.
2004/0164488 A1 * 8/2004 Fitzgerald ..... A63F 7/06 273/108.1
2004/0235410 A1 * 11/2004 Matulevich ..... A61L 9/122 454/275
2006/0094328 A1 * 5/2006 Drosendahl ..... A63H 33/006 446/227
2010/0105478 A1 * 4/2010 Hallaian ..... A63F 9/0079 463/36
2018/0035824 A1 2/2018 Goh et al.
2018/0361266 A1 12/2018 Smith
2019/0070824 A1 * 3/2019 Bargatin ..... B32B 3/12
2020/0121095 A1 4/2020 Cheng

FOREIGN PATENT DOCUMENTS

MX 2014003103 A 8/2014
WO 2004002598 A1 1/2004

* cited by examiner

AIRPLAY ACTIVITY TABLE

CROSS-REFERENCE TO RELATED APPLICATIONS

This application claims priority to U.S. Application No. 62/898,368 filed Sep. 10, 2019 and titled "AIRPLAY ACTIVITY TABLE." U.S. Application No. 62/898,368 is hereby fully incorporated by reference as if set forth fully herein.

FIELD OF THE INVENTION

The present invention is generally directed to a child's play activity table.

BACKGROUND

Children interact with a variety of playthings for development, entertainment, and education throughout childhood. Children typically respond to interactive playthings that provide multiple stimuli and sources of entertainment, especially for young children that are developing motor skills.

Conventional playthings fail to provide sustained use and enjoyment for children as they age because children physically outgrow or lose interest in conventional playthings. As such, a need exists for a child plaything that can adapt to children of multiple ages and developmental stages.

BRIEF DESCRIPTION OF THE DRAWINGS

In the accompanying drawings, like reference numerals are used to indicate like or similar parts in the various views.

DESCRIPTION OF THE INVENTION

Figure 1:
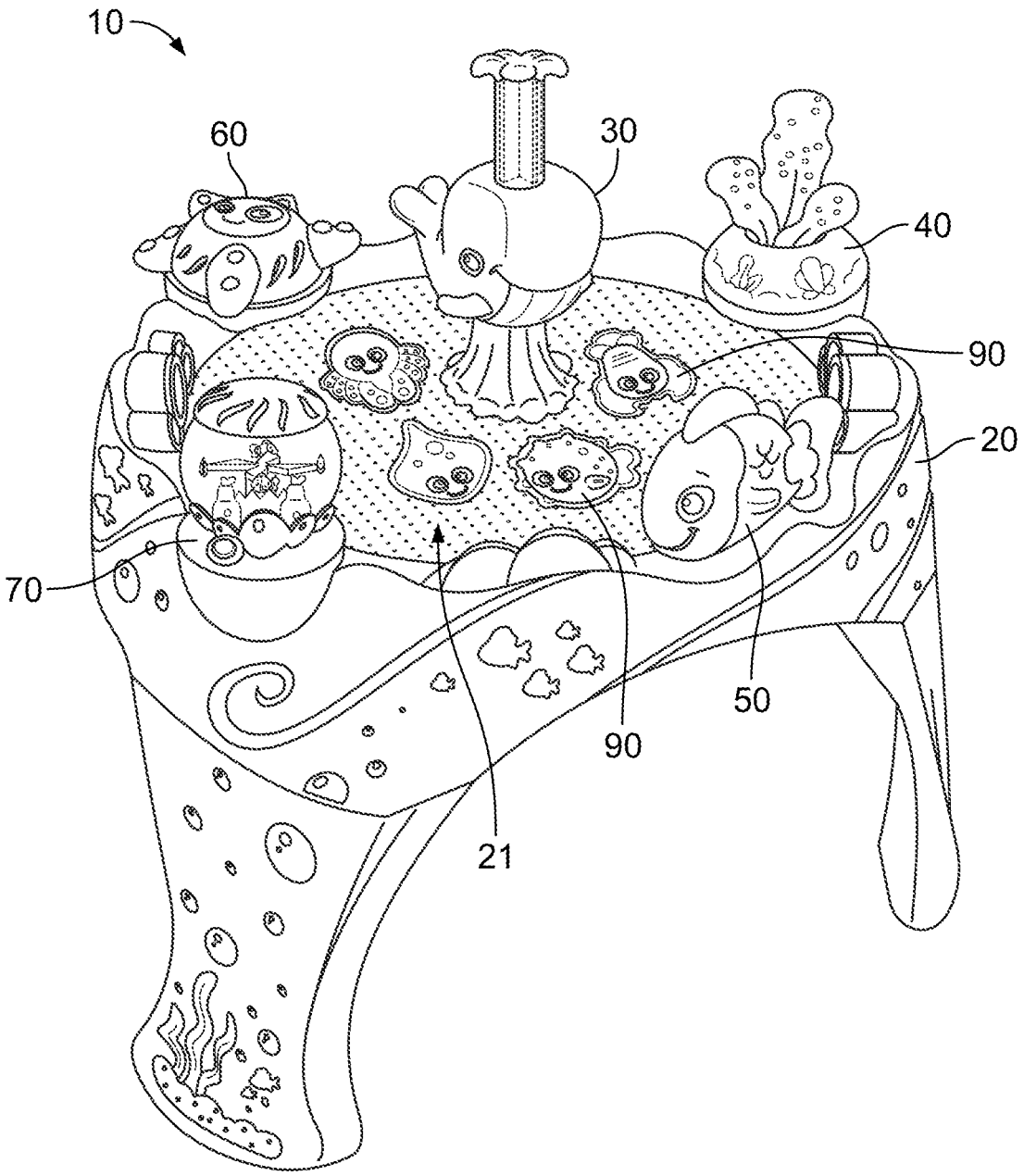
FIG. 1 is a perspective view of an air table system in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments described herein can include an air table system or an airplay activity table, which, in some embodiments can be configured to be used by infants and children. The airplay activity table can provide multiple stimuli including sliding puck toys, moving toy animals, and sources of entertainment. The airplay activity table can provide entertainment for infants and children that help develop motor skills. The exemplary embodiments can incorporate different designs and themes to appeal to different types of young children. In some embodiments, the airplay activity table's theme can be an underwater or ocean theme, but other themes could include, but are not limited to, jungle themes, farm themes, and forest themes.

FIG. 1 is a perspective view of an air table system 10 according to disclosed embodiments. As seen in FIG. 1, the air table system 10 can include a main table unit or air table 20, air activatable components 30, 40, 60, and 70 that include air activatable features, a manually activated component 50, and puck components 90. In some embodiments, the air activatable features can be configured to be activated by air blown through a plurality of holes or perforations 21 in the main table unit or air table 20.

Figure 2:
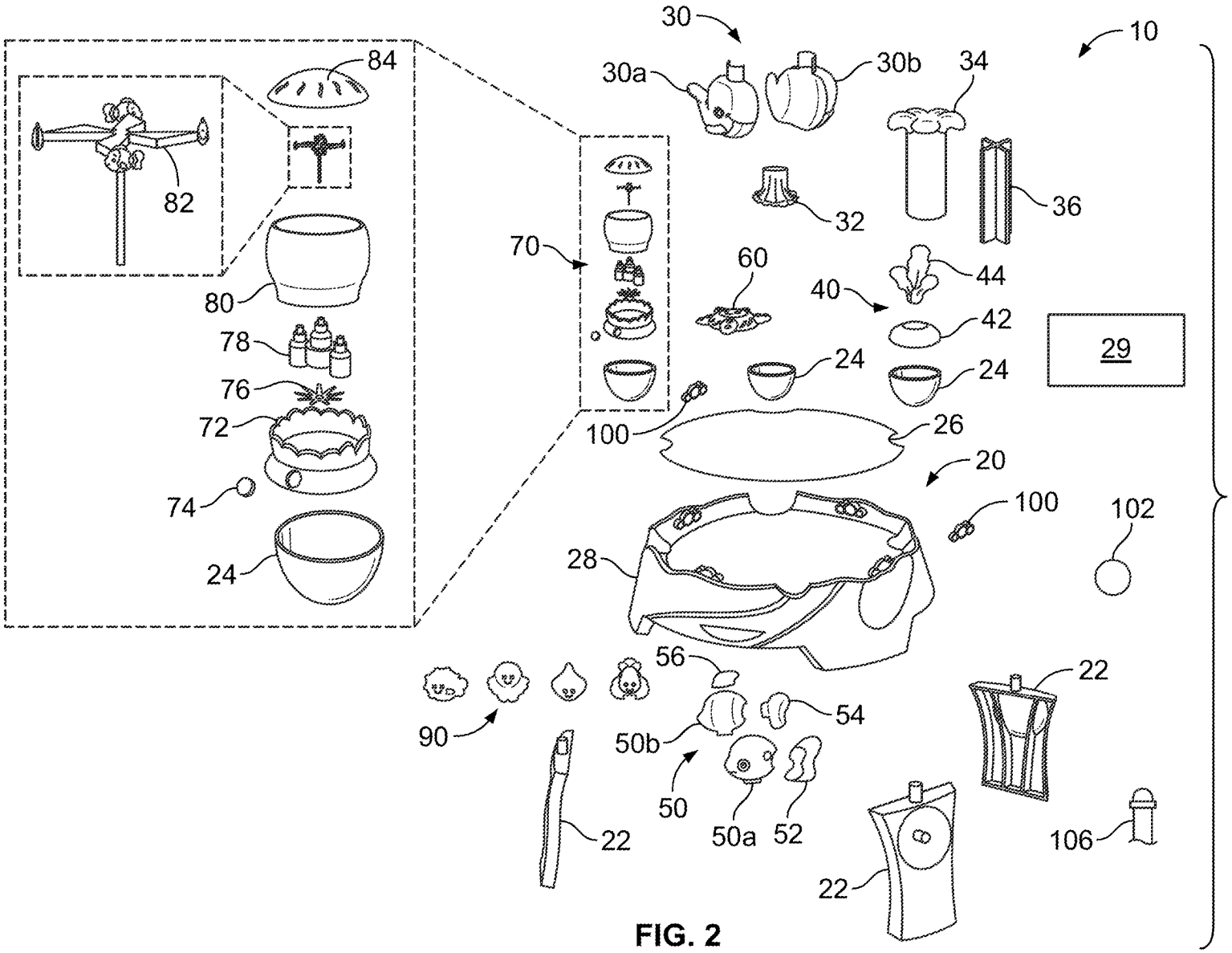
FIG. 2 is an exploded parts view an air table system in accordance with disclosed embodiments.
Figure 3:
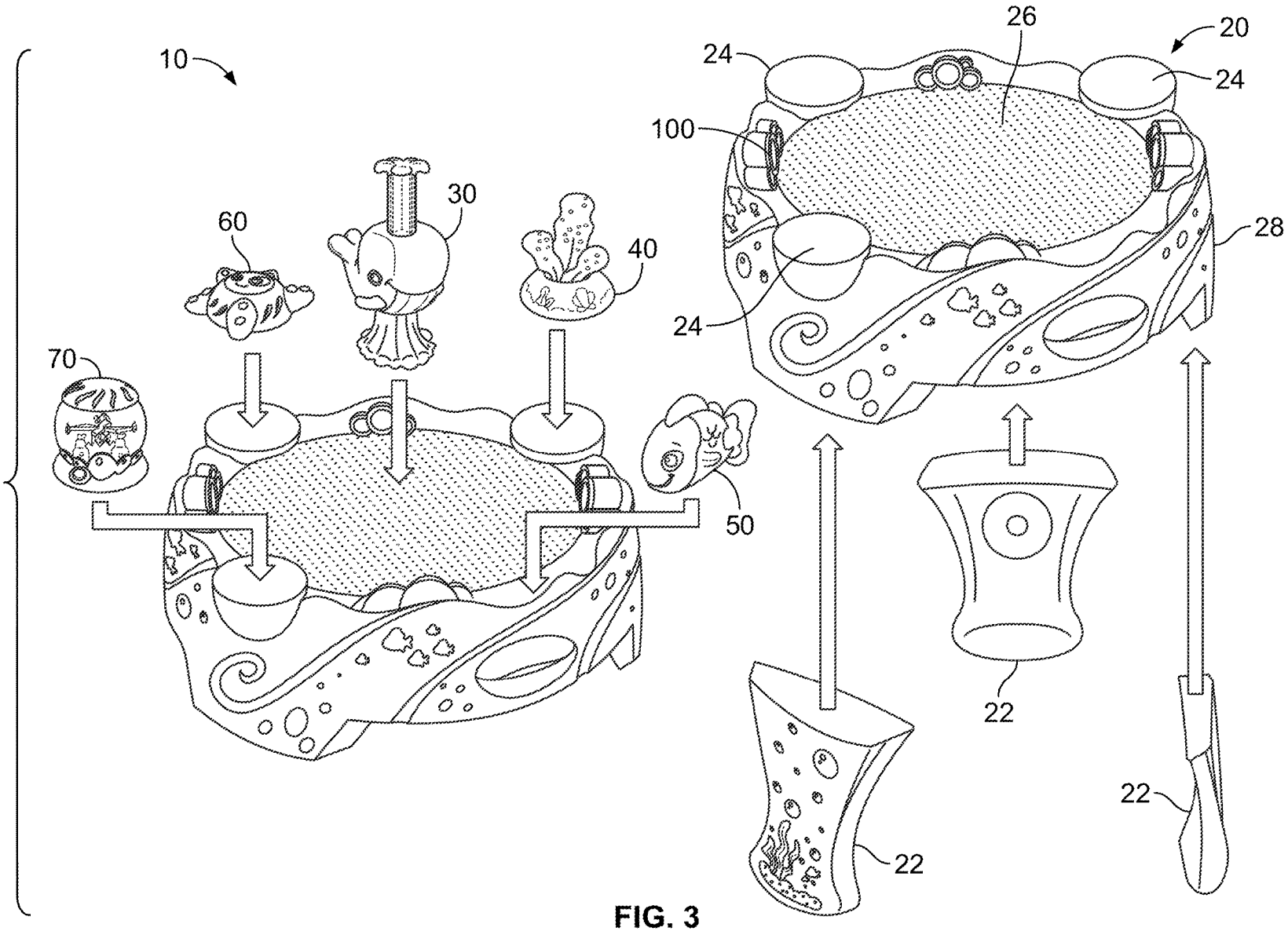
FIG. 3 is a perspective view of an air table system in accordance with disclosed embodiments.

FIG. 2 and FIG. 3 show the constituent parts of the air table system 10 according to disclosed embodiments. As seen in FIG. 2 and FIG. 3, in some embodiments, the main table unit or air table 20 can include a table support structure 28, a table top 26, a plurality of table legs 22, at least one table mount 24, and a fan and motor system 29 to blow air through the plurality of holes or perforations 21 in the table top 26. In some embodiments, the at least one table mount 24 can be configured to accommodate the air activated components 40, 60, 70, receive the air from the fan and motor system 29, and deliver the air to the air activated components 40, 60, 70 to activate the air activatable feature of the air activated components 40, 60, 70.

In some embodiments, the table support structure 28 can include a circular, triangular, square, or other polygonal shape. In a preferred embodiment, the table support structure 28 can be circular. As shown in FIG. 2, the table top 26 can be placed on the top of the table support structure 28. The table top 26 can vary in shape and size to fit within the table support structure 28. In some embodiments, the table support structure 28 and the table top 26 can each comprise the plurality of holes or perforations 21, and the plurality of holes or perforations 21 can allow the air from the fan and motor system 29 to blow through the holes or perforations 21. Various sizes for the plurality of holes or perforations 21 are contemplated. For example, in some embodiments, the plurality of holes or perforations 21 can be 1 mm in diameter.

As seen FIGS. 2-3, the plurality of table legs 22 can be inserted into the bottom of the table support structure 28 and lock in place utilizing a locking mechanism. In some embodiments, the plurality of table legs 22 can be removable, but in other embodiments, the plurality of table legs 22 can be permanently coupled to or part of the main table unit or air table 20. The size and height of the main table unit or air table 20 can vary based on the size of the table support structure 28 and the table legs 22. In some embodiments, the size and height of the main table unit or air table 20 can based on an average height of an intended age group of children that will interact with the air table system 10. The height, width, and depth of the main table unit or air table 20 can also vary.

For example, in some embodiments, the table legs 22 can be removable from the main table unit or air table 20. When the table legs 22 are attached to main table unit or air table 20, the height of the main table unit or air table 20 can increase based on the height of the table legs 22. Accordingly, when the table legs 22 are removed from the main table unit or air table 20, the total height of the main table unit or air table 20 can decrease. As such, the main table unit or air table 20 can adjust to the height of the user. Specifically, for infants, the table legs 22 can be removed so that the main table unit or air table 20 can lie directly on the floor allowing an infant to sit on the floor to play with the air table system 10. Alternatively, for a larger or older user, the table legs 22 can be inserted into the main table unit or air table 20 so that a standing child can play with the air table system 10. In some embodiments, the table legs 22 can have multiple sizes or heights allowing for incremental changes in height to the invention.

Furthermore, the main table unit or air table 20 can be made from a variety of different materials, including, but not limited to, plastic, synthetic polymers, and other materials. In some embodiments, the fan and motor system 29 can be powered by batteries. However, alternative power methods including, but not limited to, a wall plug in, solar cells, and other energy methods are contemplated. Additionally, in some embodiments, the main table unit or air table 20 can comprise a plurality of air intake holes for the fan and motor system 29. Various locations for the air intake holes are contemplated, including, but not limited to, below the table top 26.

In some embodiments, the main table unit or air table 20 can include a spill prevention mechanism 1210 that includes additional holes or perforations that enable liquids to exit the main table unit or air table 20 in the event of spills to prevent damage to electrical or mechanical parts. In some embodiments, the spill prevention mechanism 1210 can include a collection bin 1220 underneath the table top 26 and/or a spill latch 1330 under the table support structure 28. In some embodiments, the spill latch 1330 can include a door that opens to drain water, milk, or another fluid that was spilled on the table top 26. In some embodiments, the spill latch 1330 can drain spilled water, milk, or fluid into the collection bin 1220.

In some embodiments, the main table unit or air table 20 can feature protruding edges, walls, and/or side walls along the circumference of the table support structure 28 that can vary in height, design, uniformity, shape, etc. The edges, walls, or sidewalls of the main table unit or air table 20 can feature different designs such as waves, animals, or other patterns or designs. The walls of the main table unit or air table 20 can feature ridges, protrusions, or a general lack of uniformity. In some embodiments, the side walls of the main table unit or air table 20 can lack uniformity so that when the puck components 90 slide or float along the table top 26 from the air blown by the fan and motor system 29 and hit or contact the side walls of the main table unit or air table 20, the puck components 90 can bounce sporadically or unpredictably off the side walls.

Figure 4:
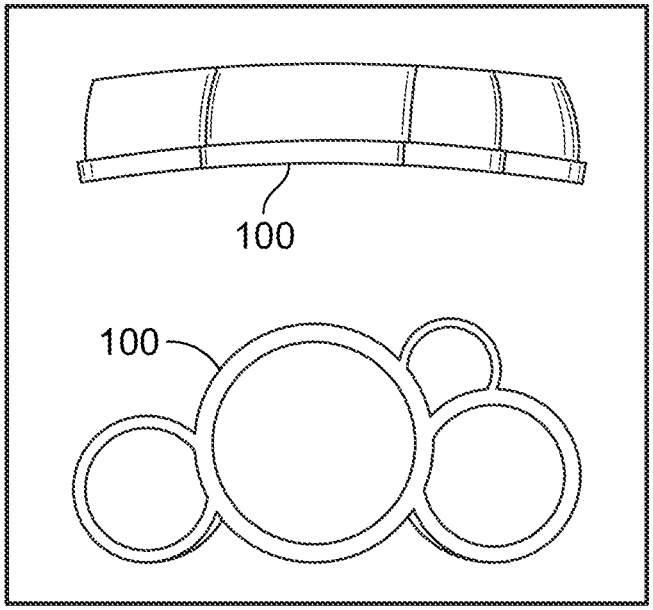
FIG. 4 illustrates an action button in accordance with disclosed embodiments.

In some embodiments, the air table system 10 can include at least one button 100 (see FIG. 4) located on an inner wall of the table support structure 28. In some embodiments, activation of the button 100 can light up LED lights 102, cause speakers to emit sounds, or cause other components of the table support structure 28 to perform other functions. The button 100 can be activated by pressing the button 100 with a hand, one of the puck components 90 hitting the button 110, activating a switch, or by other methods.

As seen in FIGS. 2-3, in some embodiments, the at least one table mount 24 can be located at the top of the table support structure 28. In some embodiments, the air table system 10 can include three table mounts 24 located at or near the circumference of the table support structure 28. In some embodiments, the table mounts 24 can be placed in recessed spots located substantially equally distant apart (i.e. each 120 degrees apart along the circumference of the table support structure 28). In some embodiments, at least one of the air activatable components 40, 60, 70 can be inserted and attached to the table mounts 24.

Figure 5:
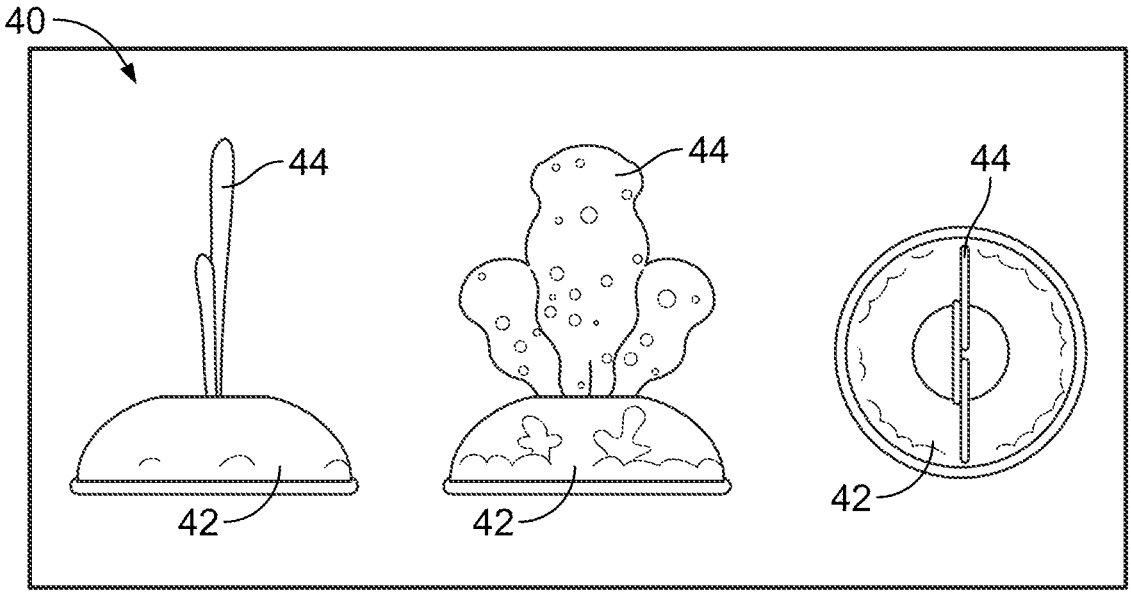
FIG. 5 illustrates an air activatable component of an air table system in accordance with disclosed embodiments.

FIG. 5 shows the air activatable component 40 according to disclosed embodiments. As seen in FIG. 5 and FIG. 2, in some embodiments, the air activatable component 40 can include an air activatable feature 44 and a base 42. In some embodiments, the air activatable feature 40 can include a grouping of flexible material coupled proximate to an outflow end of at least one opening or channel in the base 42. Furthermore, in some embodiments, an inflow end of the at least one opening or channel of the base 42 can receive the air from the fan and motor system 29 when the air activated component 40 is placed on the table top 26 or the at least one table mount 24. Further still, the at least one opening or channel of the base 42 can channel the air out the outflow end such that the grouping of flexible material flaps, flutters, or moves in response to a force exerted by the air as the air passes through the outflow end. In some embodiments, the air activatable component 40 can include a seaweed toy. In these embodiments, the base 42 can include a seaweed base and the air activatable feature 44 can include a seaweed component. In some embodiments, the seaweed component can include a plurality of layers of spun polymer to simulate natural seaweed. However, other embodiments where the seaweed component includes other materials including, but not limited to, cloth, wool, or other materials are contemplated.

Figure 6:
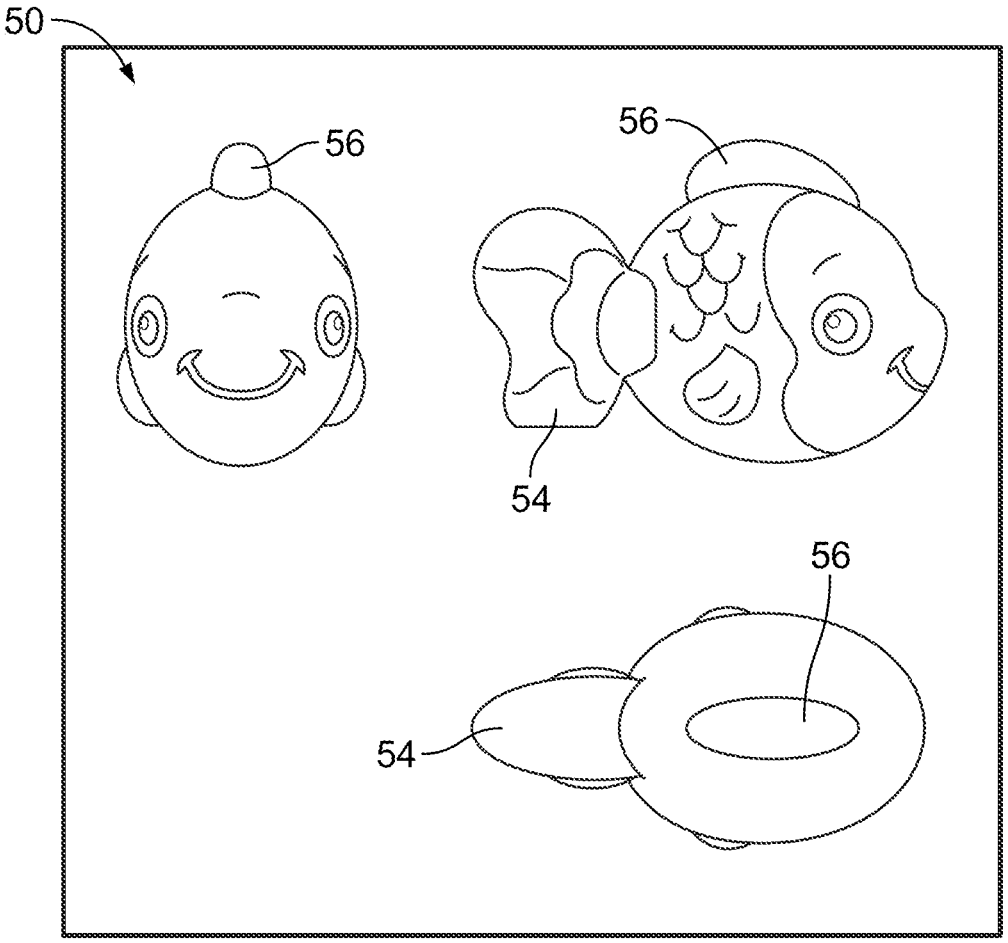
FIG. 6 illustrates a manually activated component of an air table system in accordance with disclosed embodiments.

FIG. 6 shows the manually activated component 50 according to disclosed embodiments. As seen in FIG. 6 and FIG. 2, in some embodiments, the manually activated component 50 can be coupled to a wall of the table support structure 28 and can include a depressible button 56 that articulates an articulating end 54 of the manually activated component away from the wall when the button 56 is depressed. In some embodiments, the manually activated component 50 can include a flipper fish toy. In these embodiments, the button 56 can include a top fin of the flipper fish toy and the articulating end 54 can include a tail of the flipper fish toy. In some embodiments, the flipper fish toy can comprise two mirrored halves 50(*a*) and 50(*b*) (see FIG. 2) that couple together to form the flipper fish toy. When assembled and placed on the table support structure 28, the flipper fish can be used by the child, parent, or operator by physically pressing down on the top fin to articulate the tail inward from the wall of the table support structure 28 similar to a pinball paddle. In some embodiments, the tail can strike one of the puck components 90, thereby causing the one of the puck components 90 to glide across the table top 26. When the tail is not in use, the tail can rest against the inner wall of the table support structure 28 due to a spring force pushing or pulling the tail outward toward the table support structure 28. In addition to striking the one of the puck components 90, the flipping motion of the tail can also provide stimuli and entertainment to the child or other user.

Figure 7:
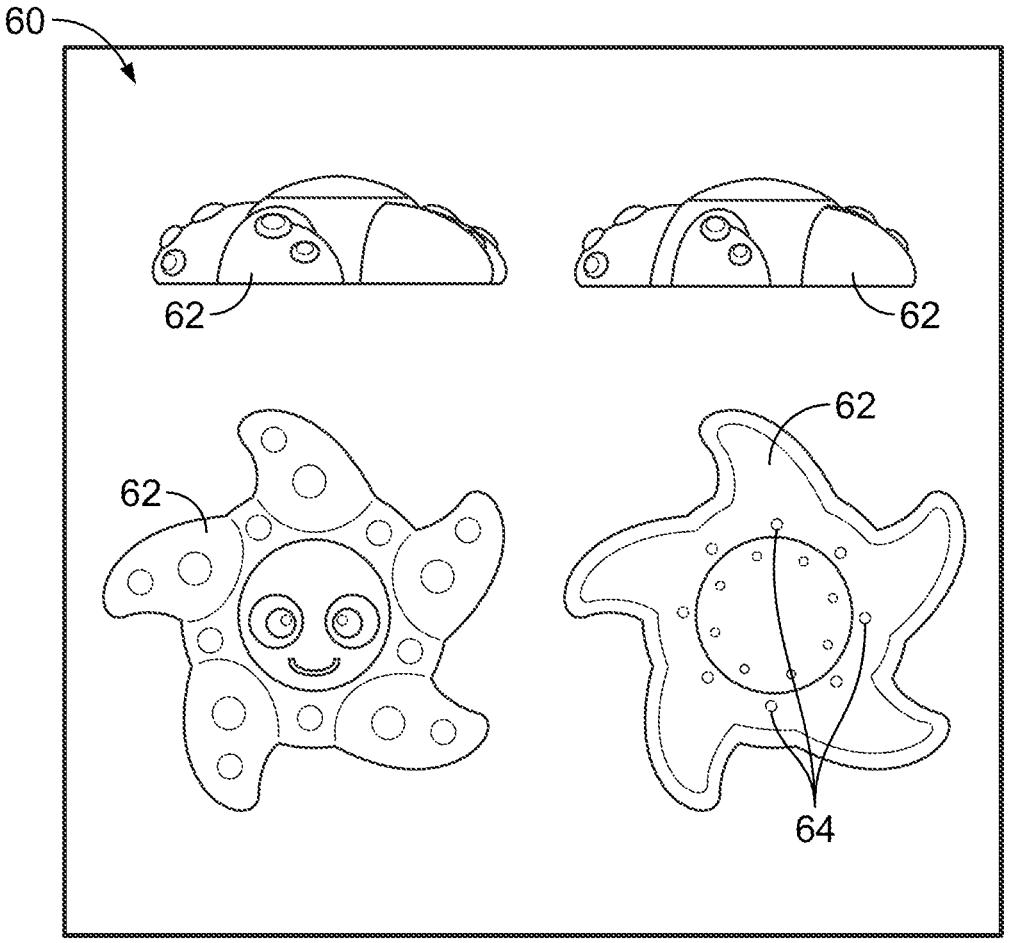
FIG. 7 illustrates an air activatable component of an air table system in accordance with disclosed embodiments.

FIG. 7 shows the air activatable component 60 according to disclosed embodiments. As seen in FIG. 7, in some embodiments, the air activatable component 60 can include a base 62 and an air activatable feature 64. In some embodiments, the air activatable feature 64 can include at least one angled opening or slot in the base 62. In some embodiments, the at least one angled opening or slot can be configured to receive the air from the fan and motor system 29 when the base 62 is placed on the table top 26 or the at least one table mount 24. Furthermore, the at least one angled opening or slot can be configured to translate upward movement of the air into a rotational force on the air activatable feature 64 such that the rotational force rotates the air activatable feature 64 in a clockwise or counter clockwise direction. In some embodiments, the air activatable component 60 can include a starfish toy placed in one of the table mounts 24 or directly on the table top 26. In some embodiments, rotation of the star fish toy can provide entertainment and stimulus to the user.

Figure 8:
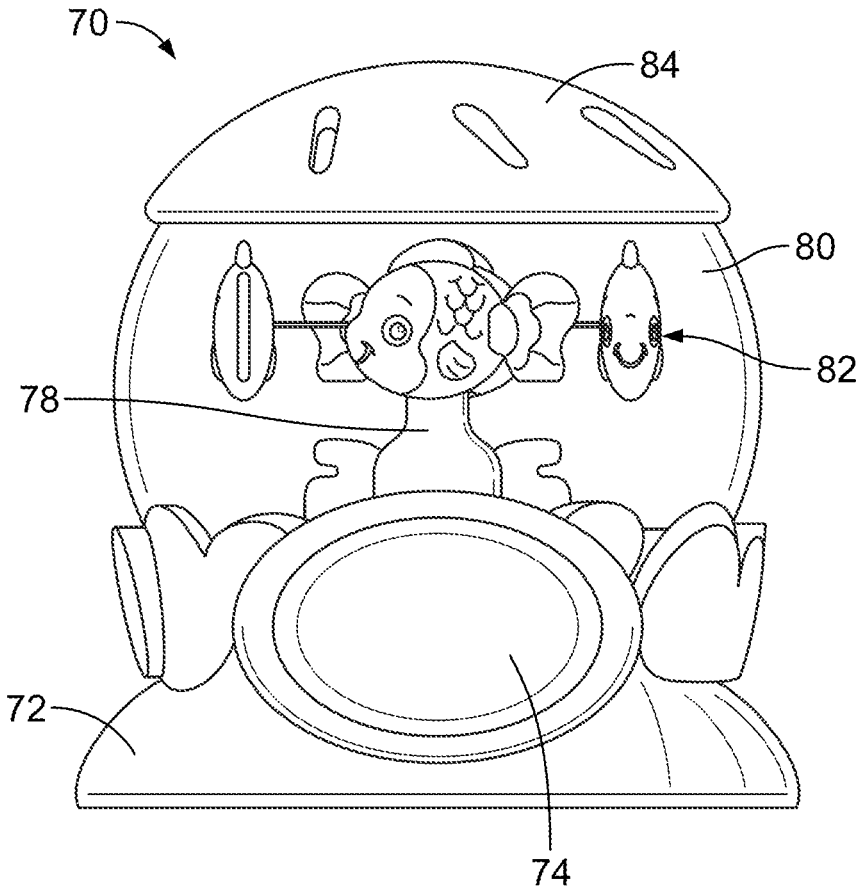
FIG. 8 illustrates an air activatable component of an air table system in accordance with disclosed embodiments.

FIG. 8 and FIG. 2 show the air activatable component 70 according to disclosed embodiments. As seen in FIG. 8 and FIG. 2, in some embodiments, the air activatable component 70 can include a base 72, a button 74, at least one opening or channel 78 in the base 72, and an air activatable feature 82. In some embodiments, the air activatable feature 82 can include a spinning element coupled to the least one opening or channel 78 in the base 72. Furthermore, the at least one opening or channel 78 can receive the air when the air activated component 70 is placed on the table top 26 or the at least one table mount 24 an channel upward movement of the air into a rotational force applied to the spinning element. In some embodiments, the air activatable component 70 can include a fan 76 that translates the upward movement of the air into the rotational force. In some embodiments, the rotational force can rotate the spinning element in a clockwise or counter clockwise direction while a remainder of the air activated component remains stationary.

In some embodiments, the button 74 can be configured to activate and deactivate the air activatable feature 82. For example, in some embodiments, the button 74 can be configured to activate or deactivate the fan and motor system 29. Additionally or alternatively, in some embodiments, the button 74 can be configured to open up or close off at least a portion of the at least one opening or channel 78 to enable or prevent the air from reaching the spinning element.

In some embodiments, the air activatable component 70 can include a bubble toy. In these embodiments, the base 72 can include a bubble base, the opening or channel 78 can be configured to resemble a castle, and the air activatable feature 82 can include a plurality of bubble fish. Furthermore, in these embodiments, the bubble toy can include a bubble 80 and a bubble top 84 that enclose the plurality of bubble fish.

Figure 9:
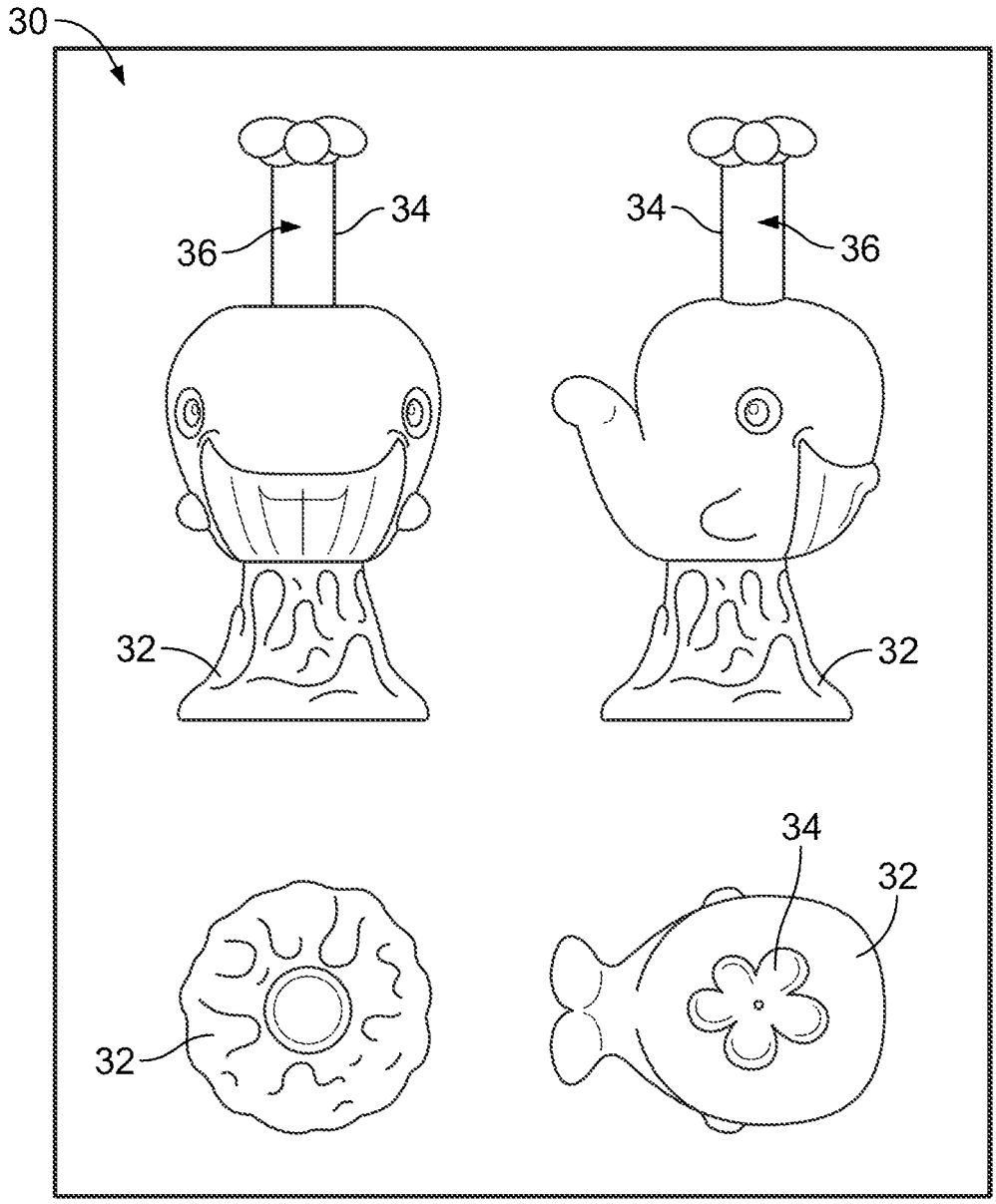
FIG. 9 illustrates an air activatable component of an air table system in accordance with disclosed embodiments.

FIG. 9 and FIG. 2 show the air activatable component 30 according to disclosed embodiments. As seen in FIG. 9 and FIG. 2, in some embodiments, the air activatable component 30 can include a base 32, at least one opening or channel 34 coupled to the base 72, and an air activatable feature 36. In some embodiments, the air activatable feature 36 can include a spinning element coupled to the least one opening or channel 34. Furthermore, the at least one opening or channel 34 can receive the air when the air activated component 30 is placed on the table top 26 or the at least one table mount 24 and channel upward movement of the air into a rotational force applied to the spinning element. In some embodiments, the air activatable feature 36 can extend at least partially inside of the at least one opening or channel 34 and can receive a rotational force that can rotate the spinning element in a clockwise or counter clockwise direction while a remainder of the air activated component 30 remains stationary. In some embodiments, the air activatable component 30 can include a whale toy. In these embodiments, the base 32 can include a whale base, the at least one channel or opening can include a spout, and the air activatable feature 36 can include a spout interior. The spout interior can be placed in the spout such that air introduced to the whale base from the fan and motor system 29 can cause the sprout interior to spin inside the spout.

Figure 10:
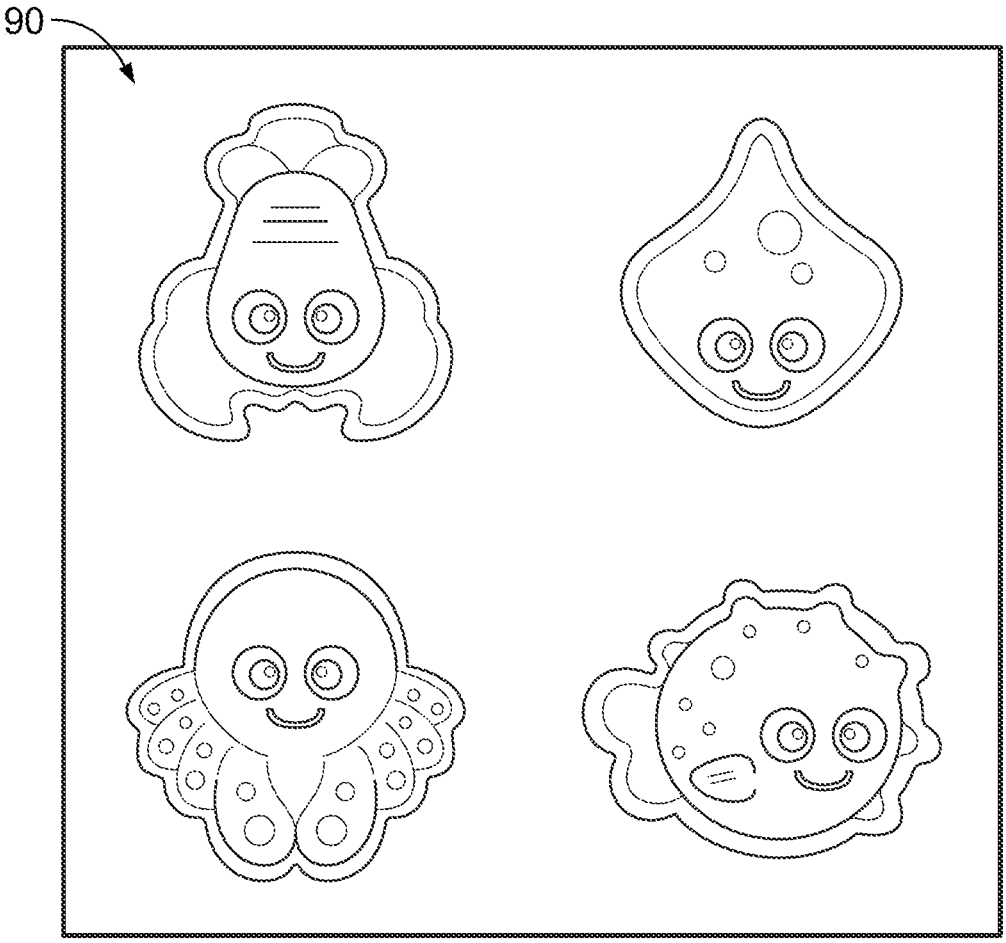
FIG. 10 illustrates puck components of an air table system in accordance with disclosed embodiments.

FIG. 10 shows the puck components 90 according to disclosed embodiments. As seen in FIG. 10, in some embodiments, the puck components 90 can include different shapes, designs and themes, such as fish and other sea creatures, although other themes are contemplated. In some embodiments, the puck components 90 can feature designs, pictures, or embedding on one or both sides of the puck component such as cartoon depictions of fish, sea animals, or other designs. In some embodiments, the puck components 90 can be made from molded plastic or other materials including, but not limited to, synthetic polymers, wood, or other plastics. The puck components 90 can also comprise angled slots on a trim section that can be molded in the plastic to allow for airflow to pass over the bottom of the puck components 90. In some embodiments, the angled slots can cause the puck components 90 to spin when air blows through the table top 26. In operation, when the puck components 90 are placed on the table top 26 and the motor and fan and motor system 29 blows the air, the air blown through the holes or perforations 21 of the table top 26 can cause the puck components 90 to easily slide across the table top 26.

In some embodiments, when the puck components 90 slide across the table top 26, the puck components 90 can interact with other components, parts, and apparatuses of the main table unit or air table 20. For example, if the puck components 90 slides across the table top 26 and hit a protrusion or angled portion of the sidewall, the puck components 90 can ricochet at an unpredictable angle. Further, if the puck components 90 slides across the table top 26 and hits the button 100, the button 100 can light up or make a sound. In some embodiments, the puck components 90 can interact with the flipper fish in that the flipper fish tail can be activated by pressing the top fin and it can hit the puck components 90 across the table top 26.

Figure 11:
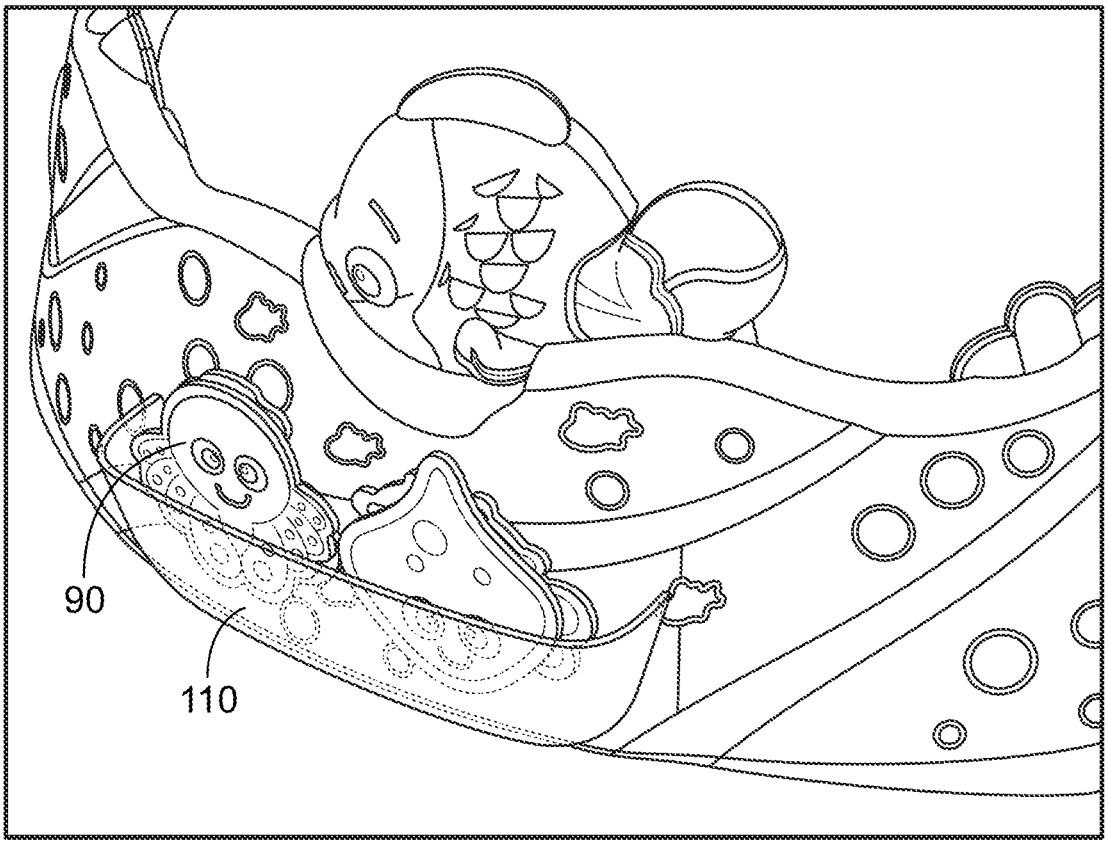
FIG. 11 illustrates a storage component of an air table in accordance with disclosed embodiments.
Figure 12:
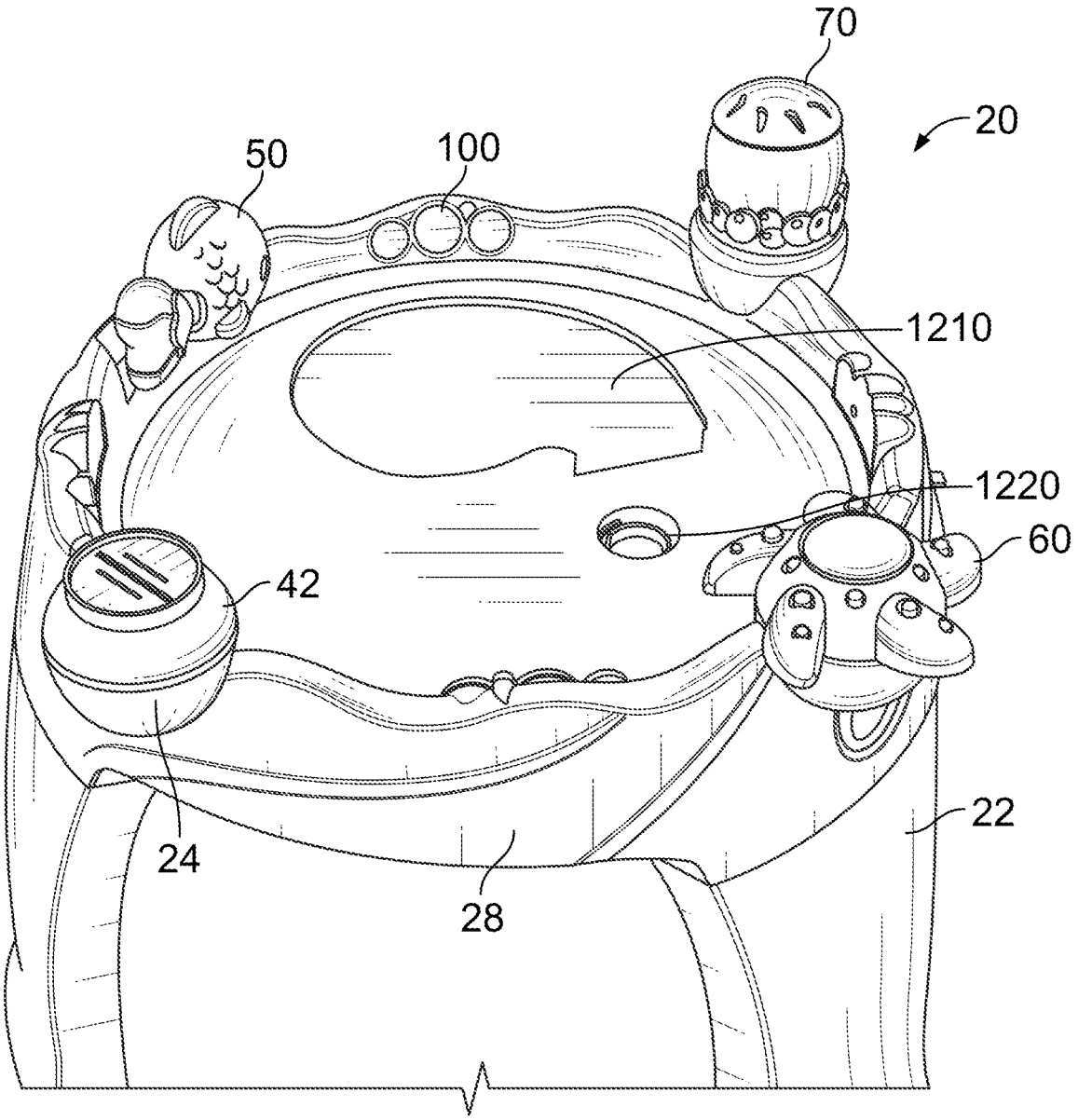
FIG. 12 illustrates the air table with a table top component removed to reveal a spill prevention mechanism in accordance with disclosed embodiments.
Figure 13:
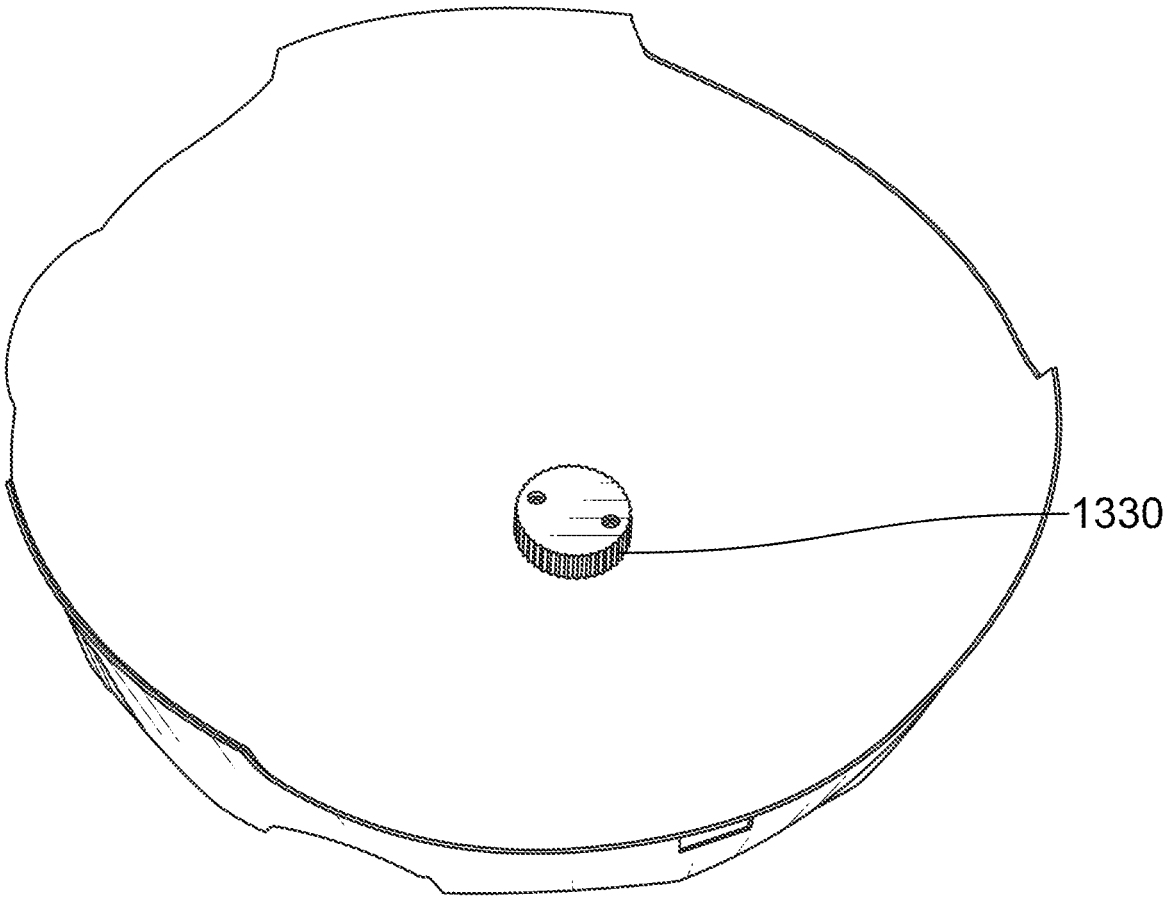
FIG. 13 illustrates an underside of the air table showing a spill latch according to an exemplary embodiment.

FIG. 11 shows a storage unit 110 according to disclosed embodiments. As seen in FIG. 11, the storage unit 110 can be located on the main table unit or air table 20 and can be configured to accommodate the puck components 90. For example, in some embodiments, the storage unit 110 can be configured to hold and store one, two, three, or more of the puck components 90 at the same time.

From the foregoing, it will be seen that this invention is one well adapted to attain all the ends and objects hereinabove set forth together with other advantages which are inherent to the structure and method. It will be understood that certain features and sub combinations are of utility and can be employed without reference to other features and sub combinations. This is contemplated by and is within the scope of the claims. Since many possible embodiments of the invention can be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "can include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A system comprising:

an air table that includes a plurality of holes or perforations;

a fan that blows air through the plurality of holes or perforations when activated;

a puck component configured to glide across the air table when the fan blows the air through the plurality of holes or perforations;

an air activated component positioned around an edge of the air table and including an air activatable feature configured to be activated by the air when the air activated component is placed on the air table; and a spill prevention mechanism configured to channel liquid spilled onto a top surface of the air table away from the fan, wherein the spill prevention mechanism includes a perforation in the air table that channels the liquid into a collection bin.

2. The system of claim 1 wherein the air activatable feature includes at least one angled opening in a base of the air activated component that receives the air from the fan when the air activated component is positioned on the air table and translates upward movement of the air into a rotational force on the air activated component, wherein the rotational force rotates the air activated component in a clockwise or counter clockwise direction.

3. The system of claim 1 wherein the air activatable feature includes a spinning element coupled to at least one opening or channel in a bottom section of the air activated component, wherein the at least one opening or channel receives the air from the fan when the air activated component is placed on the air table and channels upward movement of the air into a rotational force applied to the spinning element, wherein the rotational force rotates the spinning element in a clockwise or counter clockwise direction while a remainder of the air activated component remains stationary.

4. The system of claim 3 wherein the air activated component includes a button that opens up or closes off at least a portion of the at least one opening or channel to enable or prevent the air from reaching the spinning element.

5. The system of claim 1 further comprising a button that when activated activates or deactivates lights on the air table when the puck component touches or presses the button.

6. The system of claim 1 wherein the air activatable feature includes a grouping of flexible material coupled proximate to an outflow end of at least one opening or channel of the air activated component, wherein an inflow end of the at least one opening or channel receives the air from the fan when the air activated component is placed on the air table and channels the air to the outflow end, wherein the grouping of flexible material is configured to flap, flutter, or move in response to a force exerted by the air as the air passes through the outflow end.

7. The system of claim 1 wherein the air table includes at least one table mount configured to accommodate the air activated component, receive the air from the fan, and deliver the air to the air activated component to activate the air activatable feature.

8. The system of claim 1 further comprising:

a manually activated component coupled to a wall of the air table and including a depressible button that articulates one end of the manually activated component away from the wall when the button is depressed.

9. The system of claim 1 further comprising:

a plurality of legs that are configured to couple to the air table.

10. The system of claim 1 further comprising:

wherein the air table includes a plurality of irregular inside walls that are configured to redirect the puck component in an unpredictable manner when the puck component contacts any of the plurality of irregular inside walls.

11. The system of claim 1 further comprising:

a shelf coupled to an outside wall of the air table and configured to receive the puck component for storage therein.

12. The system of claim 1 further comprising:

a spill latch under the air table configured to hold the liquid inside the table when closed and enable the liquid to flow into the collection bin when opened.

13. A system comprising:

an air table that includes a plurality of holes or perforations;

a fan that blows air through the plurality of holes or perforations when activated;

one or more puck components configured to glide across the air table when the fan blows the air through the plurality of holes or perforations; and a plurality of air activated components positioned around an edge of the air table each including a respective air activatable feature configured to be activated by the air when the air activated component is placed on the air table; and a spill prevention mechanism configured to channel liquid spilled onto a top surface of the air table away from the fan, wherein the spill prevention mechanism includes a perforation in the air table that channels the liquid into a collection bin.

* * * * *